US007138958B2

(12) United States Patent
Syed et al.

(10) Patent No.: US 7,138,958 B2
(45) Date of Patent: Nov. 21, 2006

(54) REFLECTOR ANTENNA RADOME WITH BACKLOBE SUPPRESSOR RING AND METHOD OF MANUFACTURING

(75) Inventors: Junaid Syed, Kricaldy (GB); Roy Campbell, Ladybank (GB); David Sutherland, Lower Largo (GB)

(73) Assignee: Andrew Corporation, Westchester, IL (US)

( * ) Notice: Subject to any disclaimer, the term of this patent is extended or adjusted under 35 U.S.C. 154(b) by 123 days.

(21) Appl. No.: 10/708,393

(22) Filed: Feb. 27, 2004

(65) Prior Publication Data

US 2005/0190116 A1 Sep. 1, 2005

(51) Int. Cl.
*H01Q 7/02* (2006.01)
*H01Q 13/00* (2006.01)
*H01Q 15/02* (2006.01)

(52) U.S. Cl. ..... 343/872; 343/781 P; 343/909

(58) Field of Classification Search ..... 343/872, 343/781 P, 781 CA, 909, 911 R, 912
See application file for complete search history.

(56) References Cited

U.S. PATENT DOCUMENTS 2,413,187 A * 12/1946 McCurdy et al. ..... 343/840
3,140,491 A 7/1964 Ashbaugh et al. ..... 343/912
3,599,219 A 8/1971 Holtum, Jr. et al. ..... 343/840
4,581,615 A * 4/1986 Levy ..... 343/755
4,876,554 A * 10/1989 Tubbs ..... 343/780
5,298,911 A 3/1994 Li ..... 343/912
5,341,150 A 8/1994 Joy ..... 343/912
6,137,449 A * 10/2000 Kildal ..... 343/781 P
6,339,393 B1 1/2002 Burnside et al. ..... 342/5
6,522,305 B1 * 2/2003 Sharman ..... 343/781 CA
2002/0008670 A1 * 1/2002 Sharman ..... 343/840
2003/0038753 A1 * 2/2003 Mahon ..... 343/781 CA
2004/0233116 A1 * 11/2004 Desargant et al. ..... 343/757
2005/0248495 A1 * 11/2005 Webb et al. ..... 343/757

OTHER PUBLICATIONS

US 5,710,596, 01/1998, Oh et al. (withdrawn)

* cited by examiner

*Primary Examiner*—Hoanganh Le
*Assistant Examiner*—Angela M Lie
(74) *Attorney, Agent, or Firm*—Babcock IP, LLC

(57) ABSTRACT

A radome adapted to reduce backlobes of an associated reflector antenna via application of a conductive ring with an inward facing edge about the periphery of the radome. The conductive ring may be applied extending around the radome periphery to an inside and or outside surface of the radome. The conductive ring may be formed upon the radome by metalising, electrodaging, over molding or the like. Further, the conductive ring may be a metal, metallic foil, conductive foam or the like which is coupled to the radome. An absorber in the form of a ring or a surface coating applied to the radome and or the distal end of the reflector may also be added between the radome and the reflector.

18 Claims, 5 Drawing Sheets

REFLECTOR ANTENNA RADOME WITH BACKLOBE SUPPRESSOR RING AND METHOD OF MANUFACTURING

BACKGROUND OF INVENTION

1. Field of the Invention

This invention relates to reflector antenna radomes. More particularly, the invention relates to a reflector antenna radome with a backlobe suppression ring around the radome periphery.

2. Description of Related Art

The front to back (F/B) ratio of a reflector antenna indicates the proportion of the maximum antenna signal that is radiated in any backward directions relative to the main beam, across the operating band. Rearward signal patterns, also known as backlobes, are generated by edge diffraction occurring at the periphery of the reflector dish. Where significant backlobes are generated, signal interference with other RF systems may occur and overall antenna efficiency is reduced. Local and international standards groups have defined acceptable F/B ratios for various RF operating frequency bands.

Prior reflector antennas have used a range of different solutions to maintain an acceptable F/B ratio. For example, conical RF shields which extend forward of the reflector may be applied. However, shield structures increase the overall size, wind load and thereby structural requirements of the antenna, increasing overall antenna and antenna support structure costs. Edge profiling, chokes and or reflector edge notching/serration patterns have been formed in and or applied to the reflector dish periphery. However, these structures, in addition to significantly increasing the manufacturing costs of the resulting antenna, increase antenna wind loading and are typically optimized for a specific frequency band which limits the available market segments for each specific reflector dish design, decreasing manufacturing efficiencies.

F/B ratio is especially significant in modern shield less deep dish reflectors. Deep dish reflectors, by having a low focal length to reflector dish diameter ratio, may be formed with increased aperture efficiency and low side lobes without requiring peripheral shielding. However, to achieve these radiation patterns, the edges of the deep dish reflectors are designed to have higher signal illumination levels relative to shallow dish designs, increasing reflector edge diffraction and thereby generating significant backlobes.

Competition within the reflector antenna industry has focused attention on RF signal pattern optimization, structural integrity, as well as materials and manufacturing operations costs. Also, increased manufacturing efficiencies, via standardized reflector antenna components usable in configurations adaptable for multiple frequency bands is a growing consideration in the reflector antenna market.

Therefore, it is an object of the invention to provide an apparatus that overcomes deficiencies in the prior art.

BRIEF DESCRIPTION OF DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

The invention is described in an exemplary embodiment applied upon a radome also having toolless quick attach/detach features further described in U.S. utility patent application Ser. No. 10/604,756 "Dual Radius Twist Lock Radome and Reflector Antenna for Radome", by Junaid Syed et al, filed Aug. 14, 2003 and hereby incorporated by reference in the entirety. The invention is described herein with respect to a single profile radome. One skilled in the art will appreciate that the invention may also be applied, for example, to the dual radius radome configurations disclosed in the aforementioned application.

Figure 1:
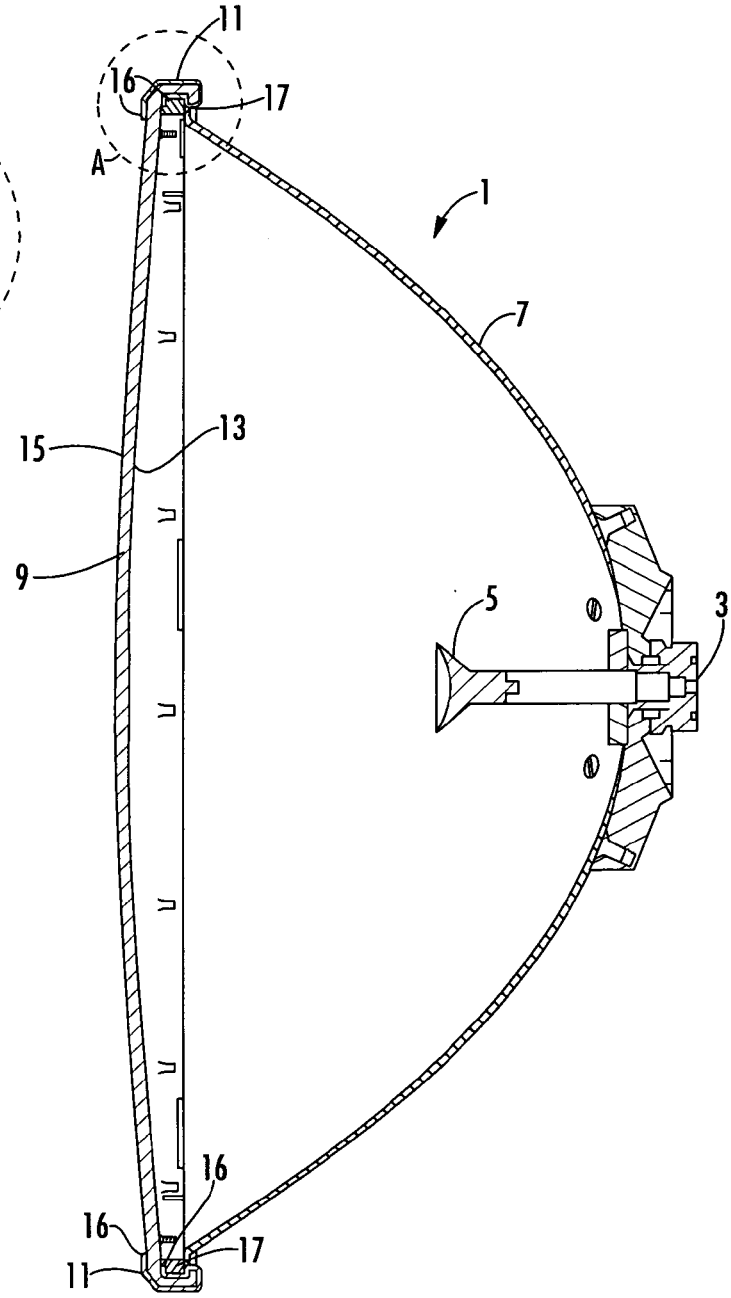
FIG. 1 is a cut-away side view of a reflector antenna with a radome according to one embodiment of the invention.

As shown in FIG. 1, a typical deep dish reflector antenna 1 projects a signal from a feed 3 upon a sub reflector 5 which reflects the signal to illuminate the reflector 7. A radome 9 covers the open distal end of the reflector 7 to form an environmental seal and reduce the overall wind load of the antenna 1.

Figure 2:
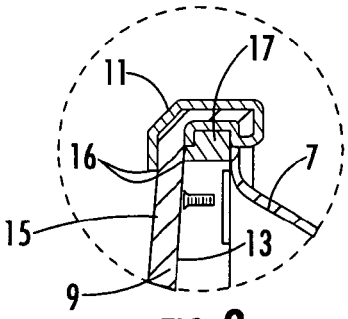
FIG. 2 is a close-up view of area A of FIG. 1.
Figure 3:
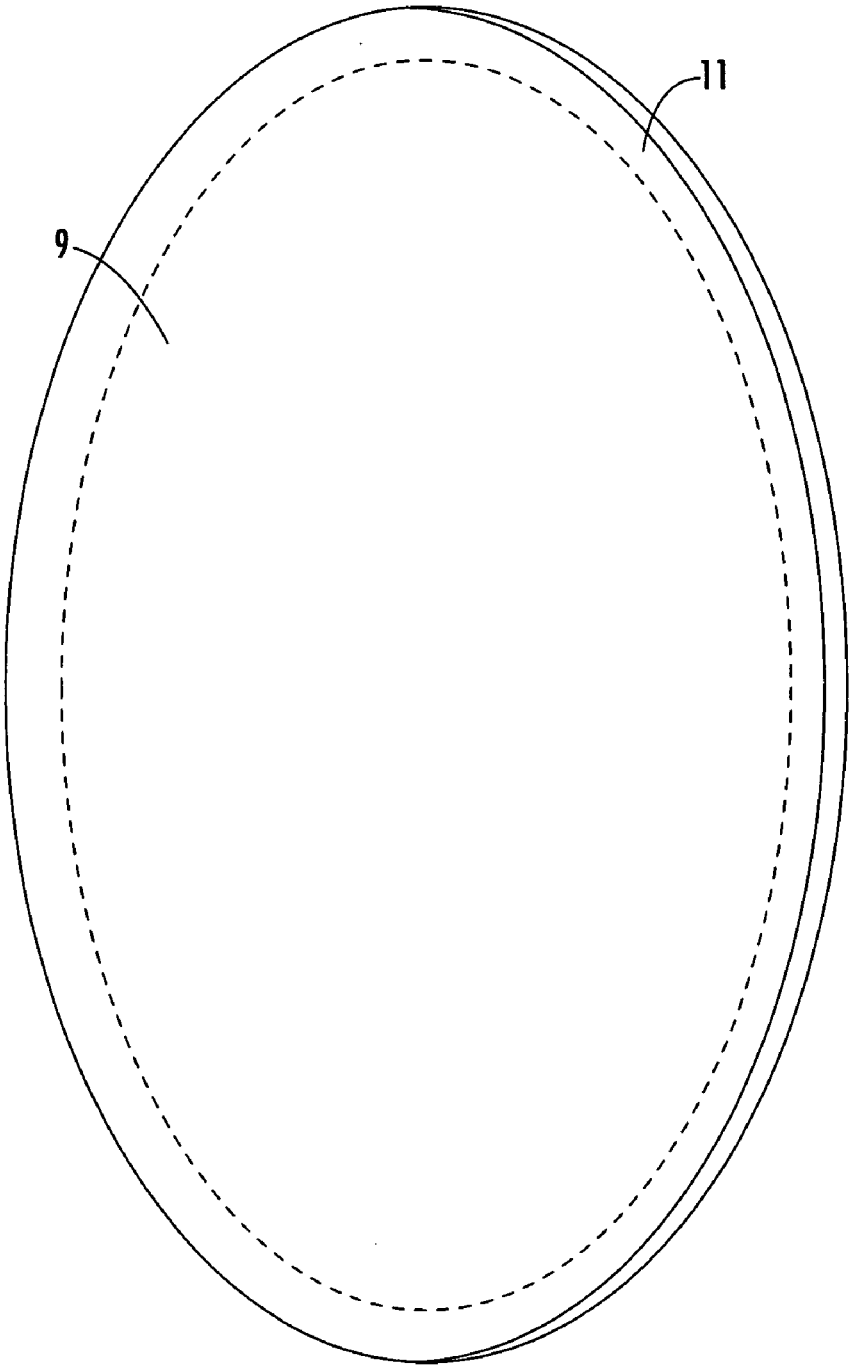
FIG. 3 is an isometric view of the radome of FIG. 1, showing the front surface and side edge.

As shown in FIGS. 2 and 3, a conductive ring herein after identified as a backlobe suppression ring (BSR) 11, is formed around the radome 9 periphery. The BSR 11 may be formed, for example, by metalising, electrodaging or over molding the edge of the radome 9. Alternatively, the BSR 11 may be formed by coupling a BSR formed of, for example, conductive rubber, metal, metallic foil, metallic tape or the like, about the radome 9 periphery. The conductive ring forming the BSR 11 need not be continuous and or interconnected around the radome circumference, for example, the conductive ring may be formed as electrically isolated segments arranged around the periphery.

As shown in greater detail in FIG. 2, where metalising or the like is used about the radome 9 periphery, the BSR 11 may be cost efficiently formed surrounding the inside 13 and the outside 15 of the radome 9 periphery. Preferably, the BSR 11 is in electrical contact with the reflector 7 periphery. Thereby, electrical gaps and or slots through which RF energy may pass to diffract from the reflector 7 outer edge are avoided.

The radome 9 has an outer diameter adapted to enable coupling of the radome 9 upon the distal open end of the reflector 7. The BSR 11, formed about the outer surface of the radome periphery does not significantly increase the radome outer diameter. Therefore, the addition of the BSR 11 to the radome 9 does not significantly add to the antenna 1 wind load. Also, because the BSR 11 may be as formed as a thin metalised layer, it does not significantly increase weight and therefore the structural requirements of the antenna 1 or antenna 1 support structures.

In operation, RF signals which would otherwise edge diffract rearward at the outward facing reflector 7 edge are instead trapped by the generally radially inward facing radome 9 outer 15 surface and or inner 13 surface edge(s) of the BSR 11. Due to the inward facing edge(s) 16 presented by the BSR 11, backwards edge diffracted energy overall is significantly reduced.

Contrary to prior frequency specific serrated, notched or choke reflector edge configurations, the BSR 11 may be applied without complex or precise design of the BSR 11 geometry. A general limit of the BSR 11 inner radius is that the BSR 11 should not project inward to a point where it will significantly interfere with the forward beam pattern of the antenna 1, for example extending inward not substantially farther than an inner diameter of the reflector 7 distal end. To further minimize spill over in forward hemisphere, an absorber 17 may be applied between the radome 9 and the reflector 7. The absorber 17 may be formed from an RF absorbing material and or an RF absorbing coating applied to the radome 9 and or the reflector 7 periphery.

Figure 4A:
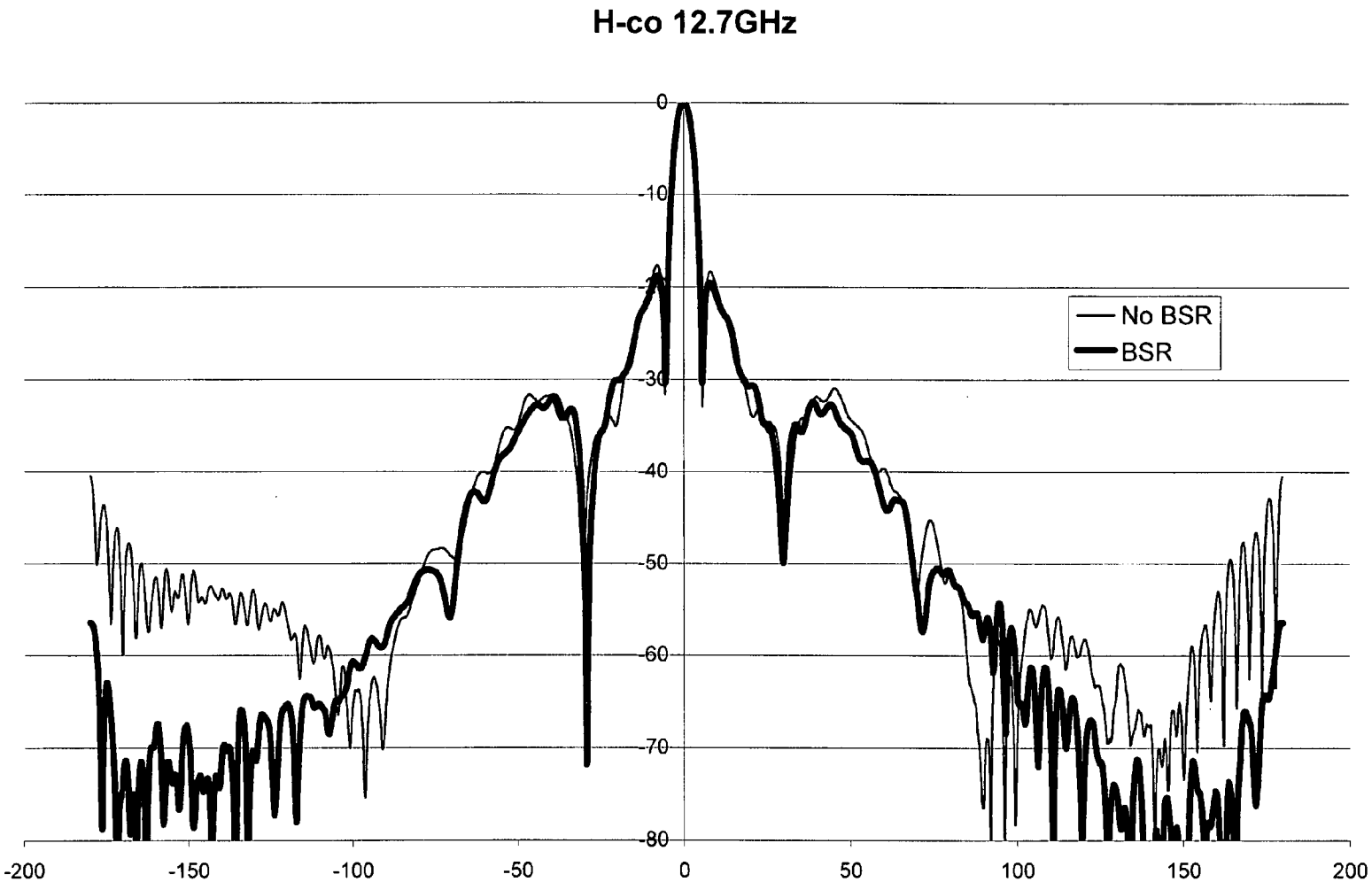
FIGS. 4*a* and 4*b* are charts demonstrating comparative measured signal radiation patterns, in h and e planes respectively, of a reflector antenna operating at 12.7 GHz with and without a backlobe suppression ring according to the invention.
Figure 4B:
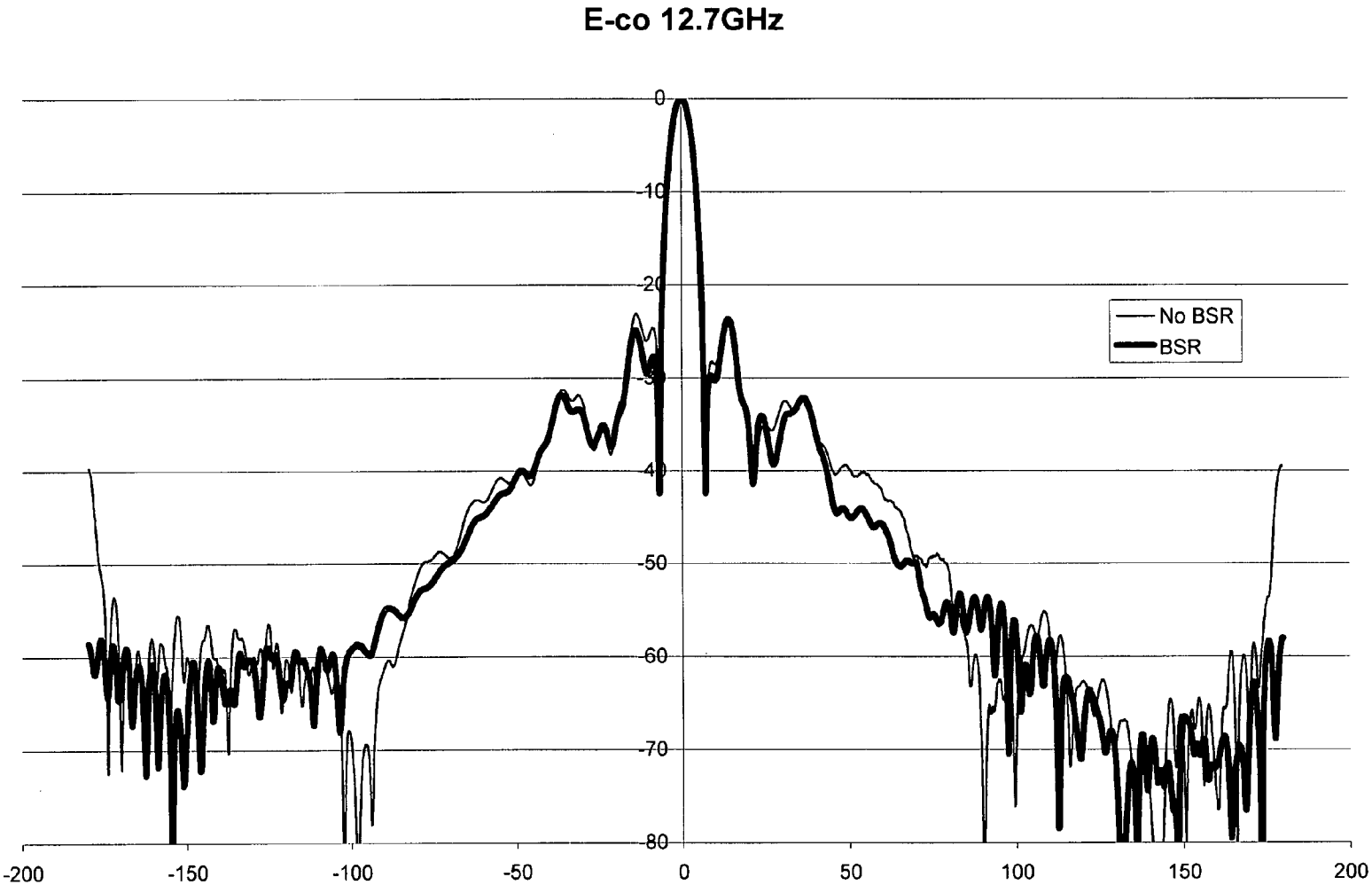

Measured test range data, as shown in FIGS. 4*a* and 4*b* obtained from 1 foot diameter deep dish reflector antennas configured for operation at 12.7 GHz demonstrates the significant backlobe reduction generated by the present invention. The axial backlobe(s), identified by the right and left edges of the e-plane and h-plane radiation patterns shown, are reduced by more than 10 dB through the addition of the BSR 11 to the radome 9. Further, the aperture control of the antenna, outside of approximately plus or minus 80 degrees, is also significantly improved. The antenna of FIGS. 4*a* and 4*b* has an outside 15 surface BSR 11 with a width, measured from the radome 9 periphery towards the radome 9 center, of 22 mm.

Figure 5:
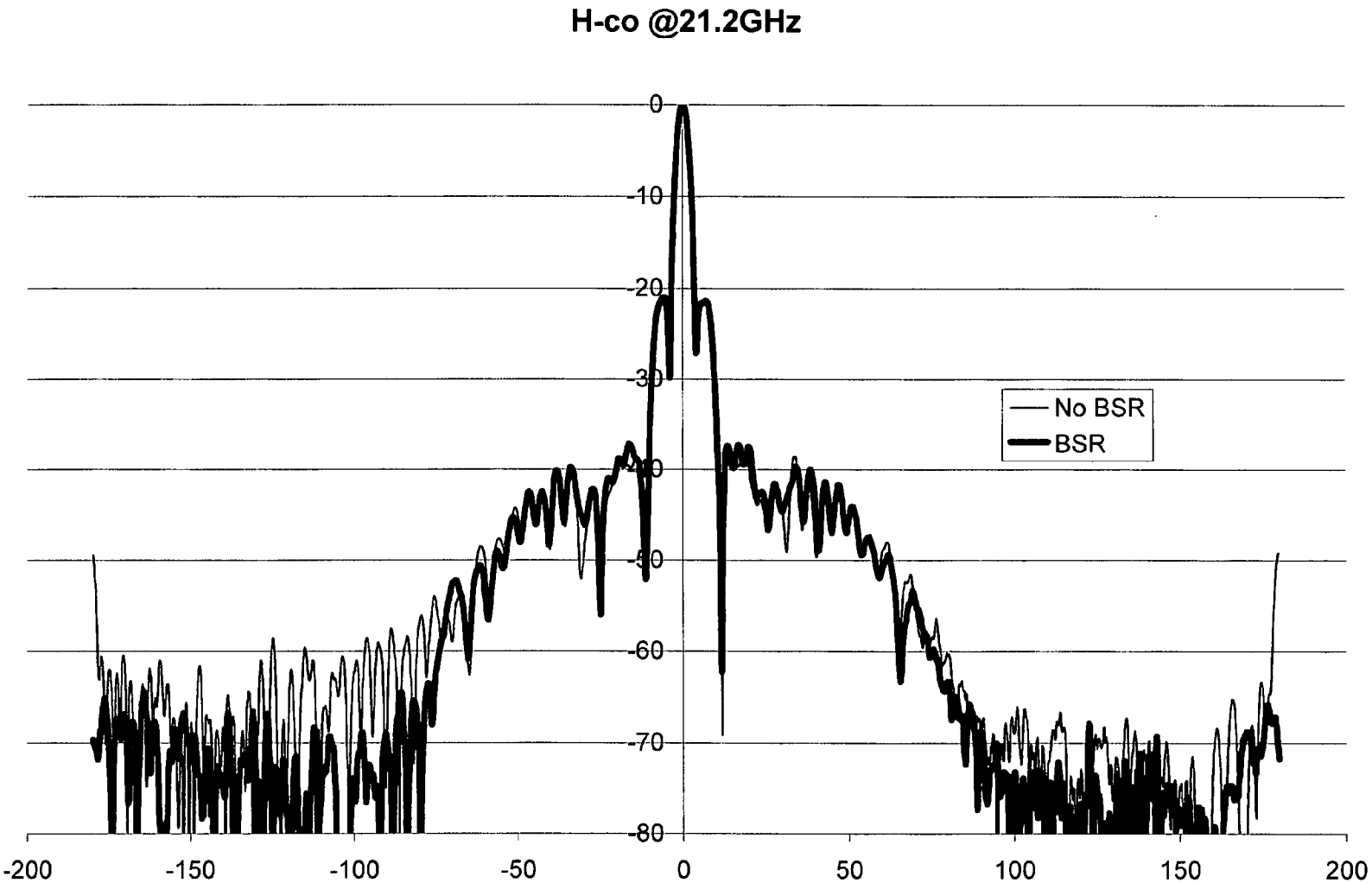
FIG. 5 is a chart demonstrating comparative measured signal radiation patterns of a reflector antenna operating at 21.2 GHz with and without a backlobe suppression ring according to the invention.

Similarly, FIG. 5 shows h-plane test data from the same reflector and radome profile (different feed assembly) operating at 21.2 GHz. This antenna 1 has an outside 15 surface BSR 11 with a width of 15 mm. Because the antennas of FIGS. 4*a*, 4*b* and 5 are able to gain the benefit of the present invention while using the same basic reflector dish and radome profile (but different feed assemblies) there is a significant manufacturing economy.

The present invention brings to the art a radome which cost efficiently improves the F/B ratio of an antenna. The invention may be applied to new or existing antennas without significantly increasing the antenna weight and or wind load characteristics. The invention provides F/B ratio improvement independent of antenna operating frequency and does not place any additional requirements upon the design and or manufacture of the reflector 7 dish.

Table of Parts

| | |
|---|---|
| 1 | reflector antenna |
| 3 | feed |
| 5 | sub reflector |
| 7 | reflector |
| 9 | radome |
| 11 | BSR |
| 13 | inside |
| 15 | outside |
| 16 | inward facing edge |
| 17 | absorber |

Where in the foregoing description reference has been made to ratios, integers, components or modules having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

The invention claimed is:

1. A radome with a front/back ratio reduction characteristic for a reflector antenna, comprising:

a radome with a conductive ring having an inward facing edge proximate a periphery of the radome;

the inward facing edge extending inward along the radome at least to an inner diameter of a distal end of a main reflector of the reflector antenna.

2. The apparatus of claim 1, wherein the conductive ring extends from an inside surface to an outside surface, around a periphery of the radome.

3. The apparatus of claim 1, wherein the conductive ring is one of metalised, electrodaged, and over molded upon the radome.

4. The apparatus of claim 1, wherein the conductive ring is one of metal, metallic foil, adhesive foil and a conductive rubber coupled to the radome.

5. The apparatus of claim 1 wherein the conductive ring is a plurality of electrically isolated segments.

6. The apparatus of claim 1, further including an absorber coupled to the inside of the radome periphery.

7. The apparatus of claim 6, wherein the absorber is one of a foam ring and an absorbing surface coating.

8. The apparatus of claim 2, wherein the conductive ring on the outside surface has a smaller inner diameter than the conductive ring on the inside surface.

9. A method for reducing the front/back ratio of a reflector antenna, comprising the steps of:

coupling a conductive ring having an inward facing edge to a periphery of a radome of the reflector antenna;

the inward facing edge extending inward along the radome at least to an inner diameter of a distal end of a main reflector of the reflector antenna.

10. The method of claim 9, wherein the conductive ring is coupled to the radome by one of metalising, electrodaging, and over molding.

11. The method of claim 9, wherein the conductive ring is formed from a plurality of electrically isolated segments.

12. The method of claim 9, wherein the conductive ring is coupled to the conductive ring whereby it extends around the periphery from an inside surface to an outside surface.

13. The method of claim 12, wherein the conductive ring on the outside surface has a smaller inner diameter than the conductive ring on the inside surface.

14. A reflector antenna with a front/back ratio reduction characteristic comprising:

a sub reflector positioned to redirect an RF signal from a feed to illuminate a reflector;

a radome adapted to cover an open distal end of the reflector; and a conductive ring coupled to the radome, the conductive ring having an inward facing edge extending inward along the radome at least to an inner diameter of a distal end of the reflector proximate a periphery of the radome.

15. The apparatus of claim 14, wherein the conductive ring extends from an inside surface to an outside surface, around a periphery of the radome.

16. The apparatus of claim 14, wherein the conductive ring has an inner diameter proximate an inner diameter of a reflector dish open end.

17. The apparatus of claim 14, wherein the conductive ring is one of metalised, electrodaged, and over molded upon the radome.

18. The apparatus of claim 14, wherein the conductive ring is one of metal, metallic foil, adhesive foil and a conductive rubber coupled to the radome.

* * * * *